United States Patent [19]

Davies

[11] Patent Number: 4,652,472

[45] Date of Patent: Mar. 24, 1987

[54] WINDOW UNIT WITH DECORATIVE BARS

[75] Inventor: Lawrence W. Davies, Winnipeg, Canada

[73] Assignee: Omniglass Ltd., Winnipeg, Canada

[21] Appl. No.: 772,915

[22] Filed: Sep. 5, 1985

[51] Int. Cl.[4] ..... E06B 3/66; E06B 3/68

[52] U.S. Cl. ..... 428/34; 428/198; 428/136; 52/456; 52/790

[58] Field of Search ..... 52/788, 790, 456; 428/34, 108, 136, 198

[56] References Cited

U.S. PATENT DOCUMENTS

| | | | |
|---|---|---|---|
| 3,308,593 | 3/1967 | Smith | 52/456 |
| 3,791,095 | 2/1974 | Martin | 52/456 |
| 3,946,531 | 3/1976 | Armstrong | 52/456 |
| 4,145,858 | 3/1979 | Douman | 52/456 |
| 4,368,226 | 1/1983 | Bucaria | 52/790 |
| 4,551,364 | 11/1985 | Davies | 52/476 |
| 4,564,540 | 1/1986 | Davies | 52/172 |

*Primary Examiner*—John E. Kittle
*Assistant Examiner*—James J. Seidleck
*Attorney, Agent, or Firm*—Adrian D. Battison; Stanley G. Ade

[57] ABSTRACT

A sealed window unit includes decorative muntin bars formed by pultruded strips of thickness very much less than the spacing between the panes of the window unit so that the strips can be interwoven and extend from one side to the other side for attachment to the spacer strips of the sealed window unit by pegs cut at the ends of the strips during a length cutting process.

5 Claims, 3 Drawing Figures

WINDOW UNIT WITH DECORATIVE BARS

BACKGROUND OF THE INVENTION

This invention relates to a window unit with decorative bars of the type known as muntin bars.

In recent years windows have become generally larger and particularly in colder climates have been manufactured as sealed window units including two or more panes which are spaced by spacer strips. Examples of this type of structure are described in co-pending U.S. application Ser. Nos. 512,469 and 630,275, (now U.S. Pat. Nos. 4,564,540 and 4,551,364) the disclosures of which are incorporated herein by a reference.

For decorative reasons it has also become popular in recent years to divide the large expanse of window into separate portions to simulate the small panes which were essential in previous years due to inadequate construction techniques that have since been considered attractive in certain styles of houses.

The large expanse of window pane is thus in many cases divided up into small square or rectangular cells by a frame or strip structure in many cases manufactured from wood and inserted inwardly of the inner sheet of glass so as to sit within the window frame. However, such a construction is often a dust trap and even though they can in many cases be removed they are difficult to clean and difficult to keep in good order.

Other arrangements have also been proposed and sold in which a frame structure is manufactured during the construction of the sealed window unit and is positioned inside the sealed window between two panes of glass. Of course such a construction keeps the frame out of the moving atmosphere and this avoids any collection of dust. Various materials have been proposed for such a construction including metal for example aluminum or steel and wood. Vinyl and other plastics have not been suitable since they generally have a very high coefficient of expansion and thus when heated by sunshine on the window can warp and otherwise distort. In addition, plastics of this type tend to give off monomer gases which can condense on a window pane and cause staining or coloring of the glass.

The steel and aluminum structures which have been proposed are expensive to construct since they must be manufactured by corner pieces or by other integral joints. In addition they provide thermal bridging between the glass panes and have unsatisfactory coefficients of thermal expansion which can cause problems.

SUMMARY OF THE INVENTION

It is one object of the present invention, therefore, to provide an improved sealed window unit of this type incorporating decorative muntin bars of a novel construction.

According to the first aspect of the invention, therefore, there is provided a sealed window unit including decorative muntin bars arranged in a grid pattern, the unit comprising a pair of glass panes of equal dimension so as to have adjacent parallel edges, a plurality of spacer strips each arranged to lie between two adjacent edges of the panes to space the panes and a plurality of said muntin bars arranged in said grid pattern between the panes each having a width sufficient to form a decorative appearance in the pane and each comprising a strip formed by pultrusion from a thermosetting material reinforced by glass fiber material extending continuously therealong.

According to the second aspect of the invention there is provided a sealed window unit including decorative muntin bars arranged in a grid pattern, the unit comprising a pair of glass panes of equal dimension so as to have adjacent parallel edges, a plurality of spacer strips each arranged to lie between two adjacent edges of the panes to space the panes and a plurality of said muntin bars arranged in said grid pattern between the panes each having a width sufficient to form a decorative appearance and a thickness not greater than one-half the spacing between the panes, and each having locating means on each end thereof for engaging and locating the end on a spacer strip whereby each bar extends from one spacer strip to another between the panes and crosses at least one other bar.

Accordingly, the preferred construction of muntin bars is provided by a thin strip of a thickness less than one-half the spacing between the glass panes so that they can be interwoven and thus be continuous from one side of the sealed window unit to an opposed side.

An interlocking technique can be provided simply by pegs which are cut on the end of the strips when they are cut to length, with the pegs projecting into cooperating holes drilled in the spacer strips centrally thereof.

Such a construction provides a simple inexpensive arrangement which can be simply manufactured from a small number of strips cut simply to length without necessity for complicated joining or coupling pieces. Furthermore, the pultruded strip enables the coefficient of thermal expansion to be tailored closely to that of glass to avoid any expansion problems. The thermal conductivity of the pultruded strip is also very low in comparison with various metals which have been previously used and thus thermal bridging is avoided.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 3:
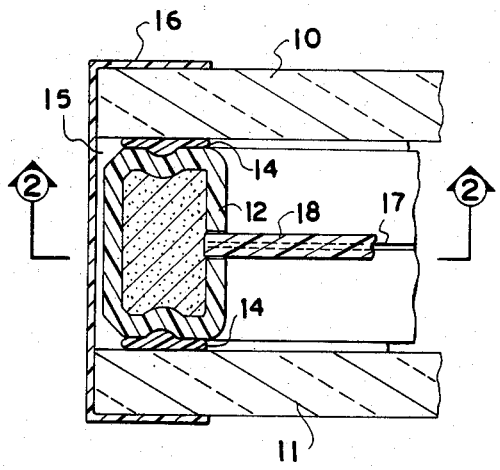
FIG. 3 is a cross sectional view along the lines 3—3 of FIG. 1 after incorporation of the frame into a sealed window unit.

The sealed window unit shown best in FIG. 3 comprises two spaced panes of glass indicated at 10 and 11 together with a spacer 12 which is formed from four pieces interconnected by corner members 13 to form a rectangle of the same dimensions as the edges of the panes 10 and 11. A sealant material 14 is positioned between the glass panes and the spacer 12 so as to ensure an air tight seal between the panes around the edges thereof. A second sealant material indicated at 15 is used to fill around the outer edge of the spaces and finally an adhesive strip 16 is applied around the outer edges of the panes and across the space therebetween covering the spacer 12.

The structure of the sealed window unit and particularly the spacer 12 and the corner member 13 are described in detail in described in detail in co-pending U.S. application Ser. No. 512,469 now U.S. Pat. No. 4,564,540, the disclosure of which is incorporated herein by reference.

It will be noted that the spacer includes a slot 17 extending along the length thereof and as described in the above patent document is formed by pultrusion from a thermosetting resin material which is reinforced by longitudinally extending or continuous glass fiber material.

The muntin bars each comprise a flat strip 18 of approximately one half inch in width and of the order of one-eighth inch in thickness. The bars are formed by pultrusion from a thermosetting resin material with continuous fibers 19 of glass fiber which act as reinforcement. Pultrusion is a known technique and one example suitable for forming the bars is disclosed in the above mentioned U.S. Pat. No. 4,564,540. Pultrusion of a flat strip of this type is of course technically simple and the bars or flat strip can be manufactured in continuous length for cutting into the required lengths.

Figure 2:
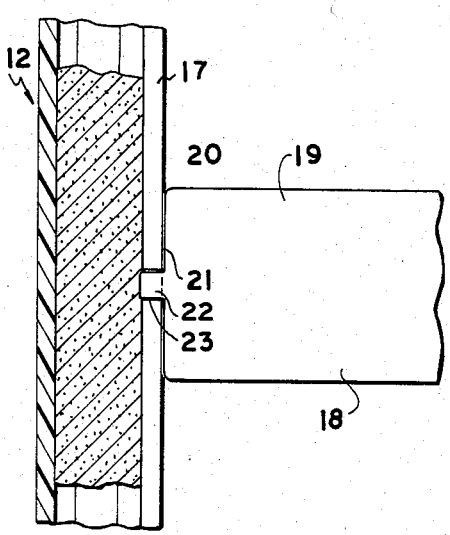
FIG. 2 is an enlarged cross sectional view of one end of one of the bars incorporated into a sealed window unit and taken along the lines 2—2 of FIG. 3.

Each bar or strip 18 is thus cut to a required length by a tool which acts to slightly chamfer the corners as indicated, to cut the majority of the material along a transverse line 21 but to leave a projection or peg 22 at a central position of the bar and covering approximately one-eighth inch in width. In this way the peg is effectively square in cross section since its width in the section shown in FIG. 3 is approximately equal to the width in the section shown in FIG. 2 and thus it can be received in a square or circular hole 23 punched in the strip 12 at the slot 17.

Figure 1:
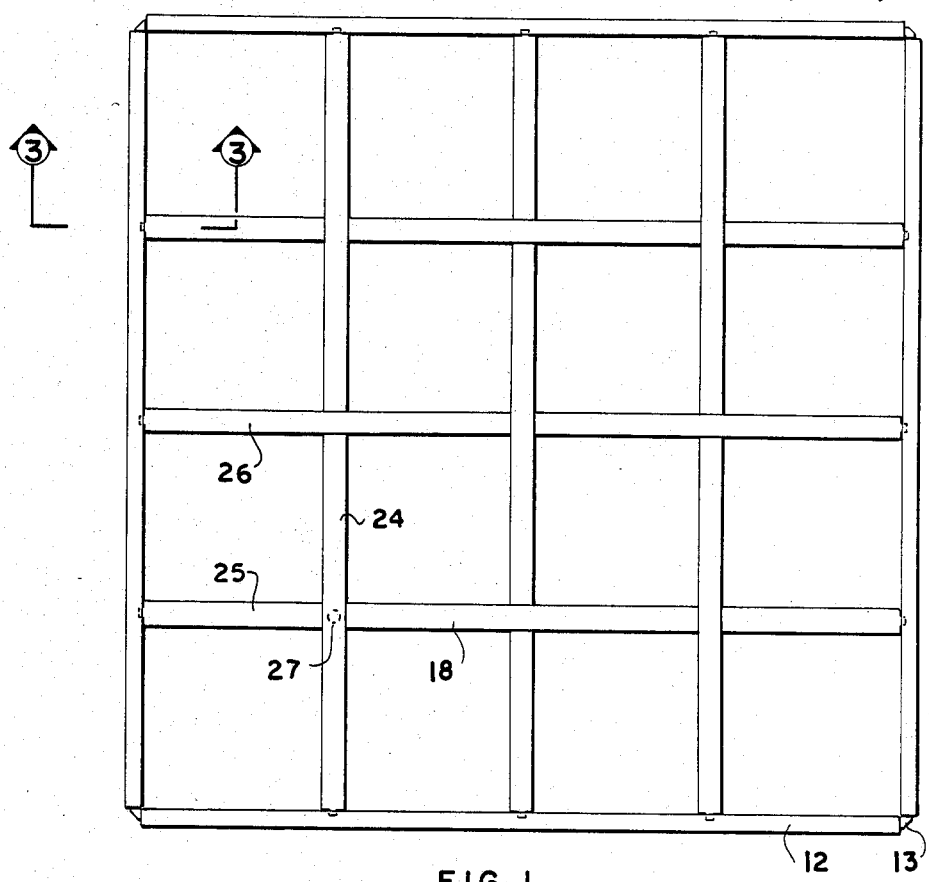
FIG. 1 is a front elevational view of spacer strips and decorative muntin bars assembled into a frame structure for insertion into a sealed window unit.

In the example illustrated in FIG. 1, the sealed window unit is square so that the four sides are equal and also the three bars crossing from one side to an opposed side are all equal in length with the opposed three bars crossing in the opposite direction.

As the bars or strips 18 are very much less thick than the spacing between the glass panes, they can be simply slightly distorted so as to be interwoven as shown in FIG. 1. Thus one strip indicated at 24 passes over a first strip indicated at 25 and under a second strip indicated at 26. In this way the strips can extend completely from one side to the opposed side of the sealed window unit without any junctions therebetween and using simple attachment provided by the pegs 22. An adhesive indicated schematically at 27 can be used if required between each strip and each crossing strip to increase the rigidity of the structure.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A sealed window unit including decorative muntin bars arranged in a grid pattern, the unit comprising a pair of glass panes of equal dimension so as to have adjacent parallel edges, a plurality of spacer strips each arranged to lie between two adjacent edges of the panes to space the panes and a plurality of said muntin bars arranged in said grid pattern between the panes, each of said muntin bars being formed by pultrusion from a thermosetting material reinforced by glass fiber material extending continuously therealong so as to form an elongate solid body of constant cross section having a width sufficient to form a decorative appearance and a thickness less than one-half the spacing between the panes, and each having a locating peg of reduced width relative to the bar and of the same thickness as the bar on each end thereof for engaging and locating the end in an opening formed centrally of a spacer strip whereby each bar extends from one spacer strip to another between the panes and crosses at least one other bar to form an interwoven structure.

2. The invention according to claim 1 wherein the peg is formed by cutting away part of the bar when the end of the bar is cut to length.

3. The invention according to claim 1 wherein each spacer strip includes a slot along the length of the inner face of a width sufficient to allow the ingress of moisture while preventing the escape of a dessicant and wherein the opening is drilled centrally of the inner face so as to pass through said slot.

4. The invention according to claim 1 wherein said bar is glued to at least one other bar at a point of crossing.

5. The invention according to claim 1 wherein the thickness of the bars is of the other or one-eighth inch.

* * * * *